US010370787B2

(12) United States Patent
Bae et al.

(10) Patent No.: US 10,370,787 B2
(45) Date of Patent: Aug. 6, 2019

(54) CONTROL METHOD OF WASHING MACHINE

(75) Inventors: Sun Cheol Bae, Changwon-si (KR); Ja In Koo, Changwon-si (KR); Jae Hyeok Choi, Changwon-si (KR); Han Su Jung, Changwon-si (KR); Kyung Hoon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/320,758

(22) PCT Filed: Aug. 31, 2010

(86) PCT No.: PCT/KR2010/005859

§ 371 (c)(1),
(2), (4) Date: May 8, 2012

(87) PCT Pub. No.: WO2011/025339

PCT Pub. Date: Mar. 3, 2011

(65) Prior Publication Data

US 2012/0210518 A1 Aug. 23, 2012

(30) Foreign Application Priority Data

Aug. 31, 2009 (KR) ..... 10-2009-0081094
Aug. 31, 2009 (KR) ..... 10-2009-0081095

(51) Int. Cl.
*D06F 39/00* (2006.01)
*D06F 35/00* (2006.01)
*D06F 33/02* (2006.01)

(52) U.S. Cl.
CPC ..... *D06F 33/02* (2013.01); *D06F 35/006* (2013.01); *D06F 39/003* (2013.01);
(Continued)

(58) Field of Classification Search
CPC ..... D06F 1/00; D06L 1/00
(Continued)

(56) References Cited

U.S. PATENT DOCUMENTS 7,047,583 B2 * 5/2006 Kim et al. ..... 8/159
2001/0011395 A1 8/2001 Skripper et al.
(Continued)

FOREIGN PATENT DOCUMENTS

DE 19832292 A1 1/2000
EP 1 428 925 A1 6/2004
(Continued)

OTHER PUBLICATIONS

PCT International Search Report dated Feb. 25, 2011 for Application No. PCT/KR2010/005859, 3 pages.
(Continued)

*Primary Examiner* — Gregory R Delcotto
*Assistant Examiner* — Preeti Kumar
(74) *Attorney, Agent, or Firm* — Fish & Richardson P.C.

(57) ABSTRACT

A control method of a washing machine determines the amount of laundry placed in a drum, verifies whether the measured amount of laundry is accurate, and sets control data in the washing machine based on the verified amount of laundry. Also the control method of the washing machine corrects control data set according to the amount of laundry based on kind of the laundry classified according to absorptance of the laundry.

20 Claims, 6 Drawing Sheets

(52) U.S. Cl.
CPC .... *D06F 2202/10* (2013.01); *D06F 2204/086* (2013.01); *D06F 2232/04* (2013.01)

(58) Field of Classification Search
USPC ..... 8/137, 159; 68/23
See application file for complete search history.

(56) References Cited

U.S. PATENT DOCUMENTS

| | | | | |
|---|---|---|---|---|
| 2004/0006831 | A1 | 1/2004 | Kim et al. | |
| 2004/0103485 | A1 | 6/2004 | Do et al. | |
| 2004/0144135 | A1 | 7/2004 | Oh | |
| 2004/0163183 | A1* | 8/2004 | Kim | 8/137 |
| 2005/0086742 | A1 | 4/2005 | Kim et al. | |
| 2006/0016228 | A1* | 1/2006 | Chang et al. | 68/23.1 |
| 2007/0107473 | A1* | 5/2007 | Park | 68/12.14 |
| 2009/0044346 | A1* | 2/2009 | Koo | D06F 33/02 8/159 |
| 2011/0048078 | A1* | 3/2011 | Tobi et al. | 68/12.13 |

FOREIGN PATENT DOCUMENTS

| | | | |
|---|---|---|---|
| EP | 1526211 | A1 | 4/2005 |
| JP | 2001-321591 | A | 11/2001 |
| KR | 199408628 | B1 | 9/1994 |
| KR | 2004046082 | A | 6/2004 |
| KR | 10-0473319 | | 3/2005 |
| KR | 10-2009-0013354 | | 2/2006 |
| KR | 2007002434 | A | 1/2007 |
| KR | 2007073143 | A | 7/2007 |

OTHER PUBLICATIONS

European Search Report dated Feb. 26, 2014 for Application No. 10812352.2, 4 pages.

* cited by examiner

[Fig. 1]
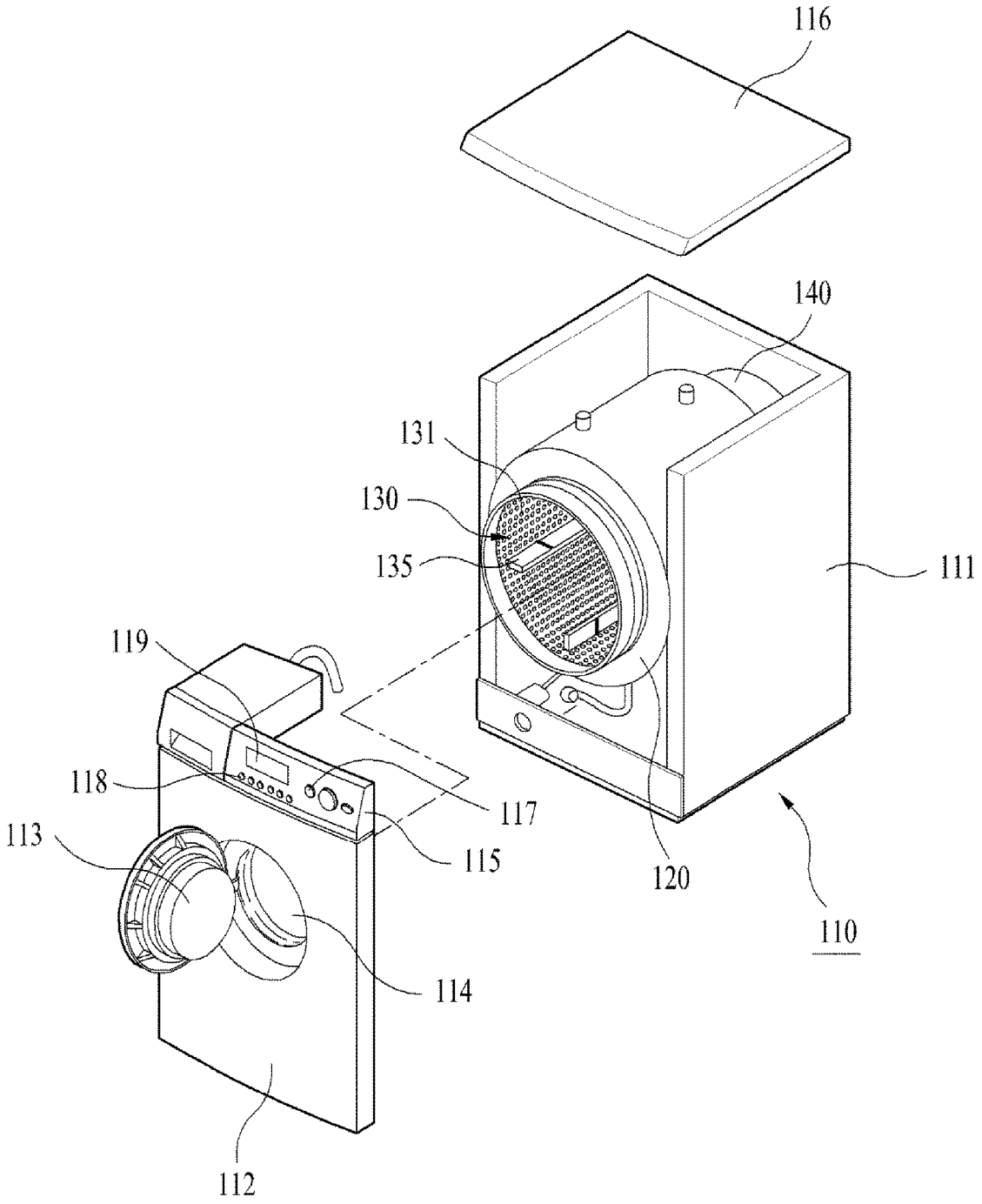

[Fig. 2]
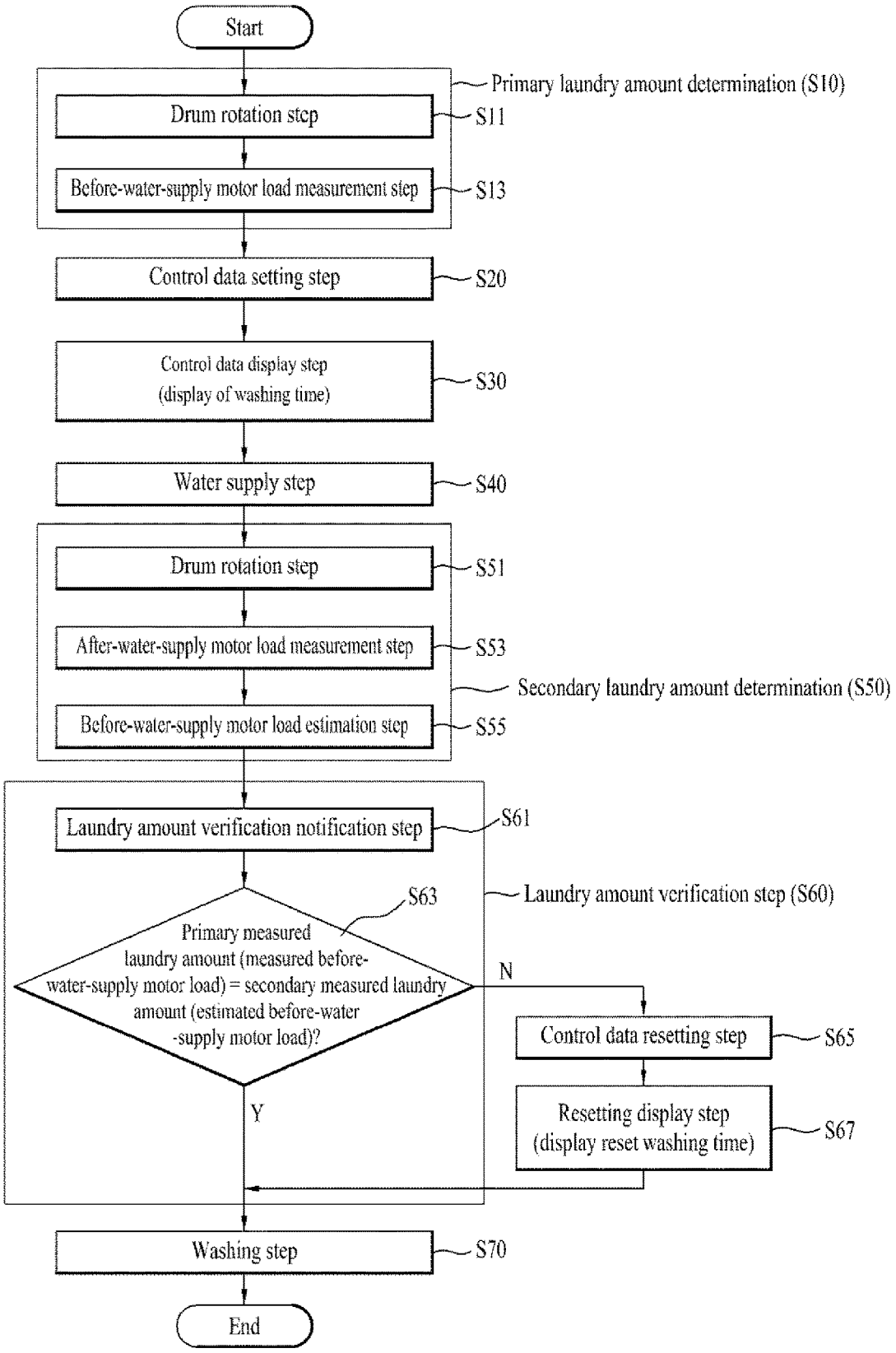

[Fig. 3]
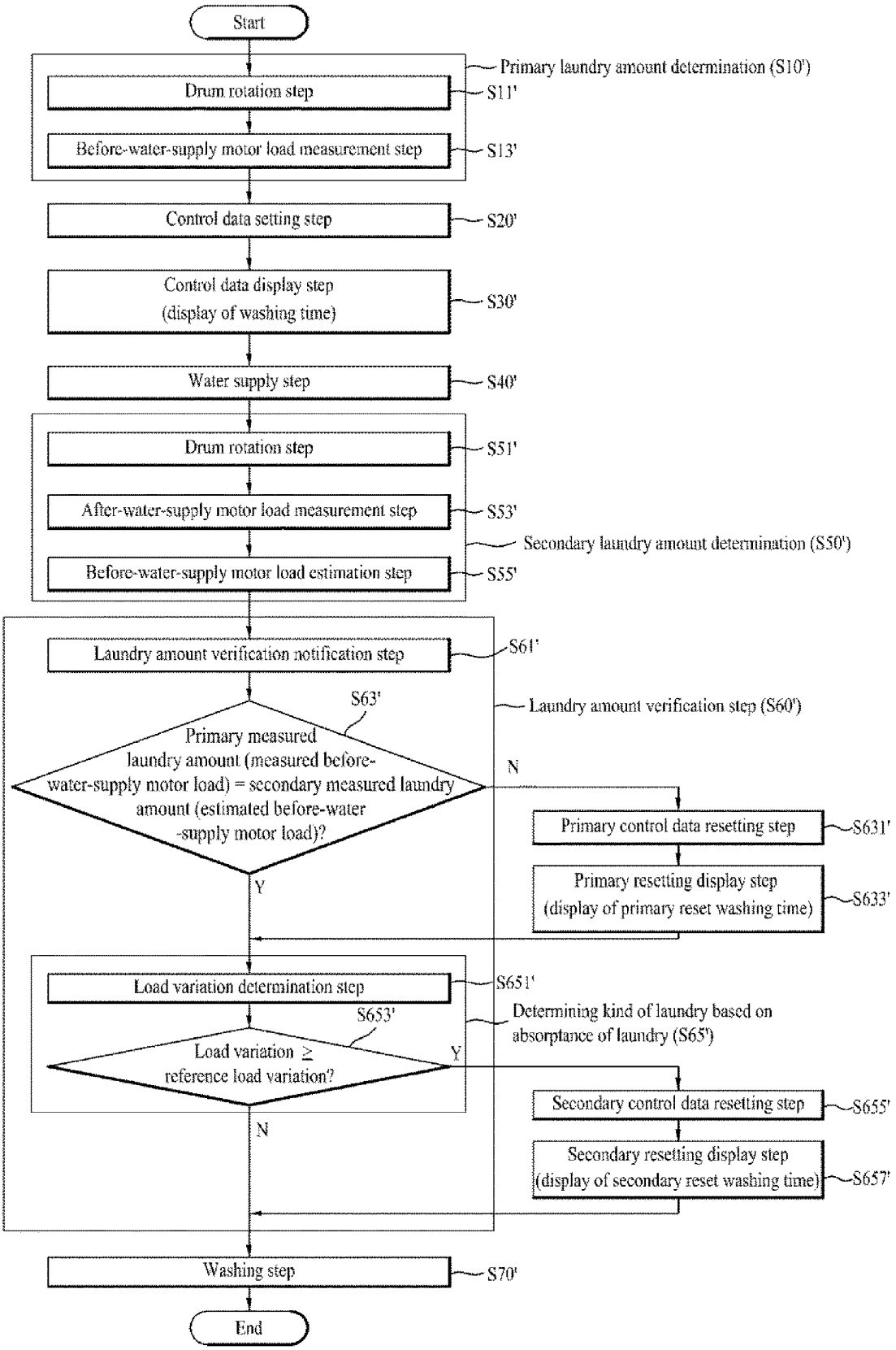

[Fig. 4]
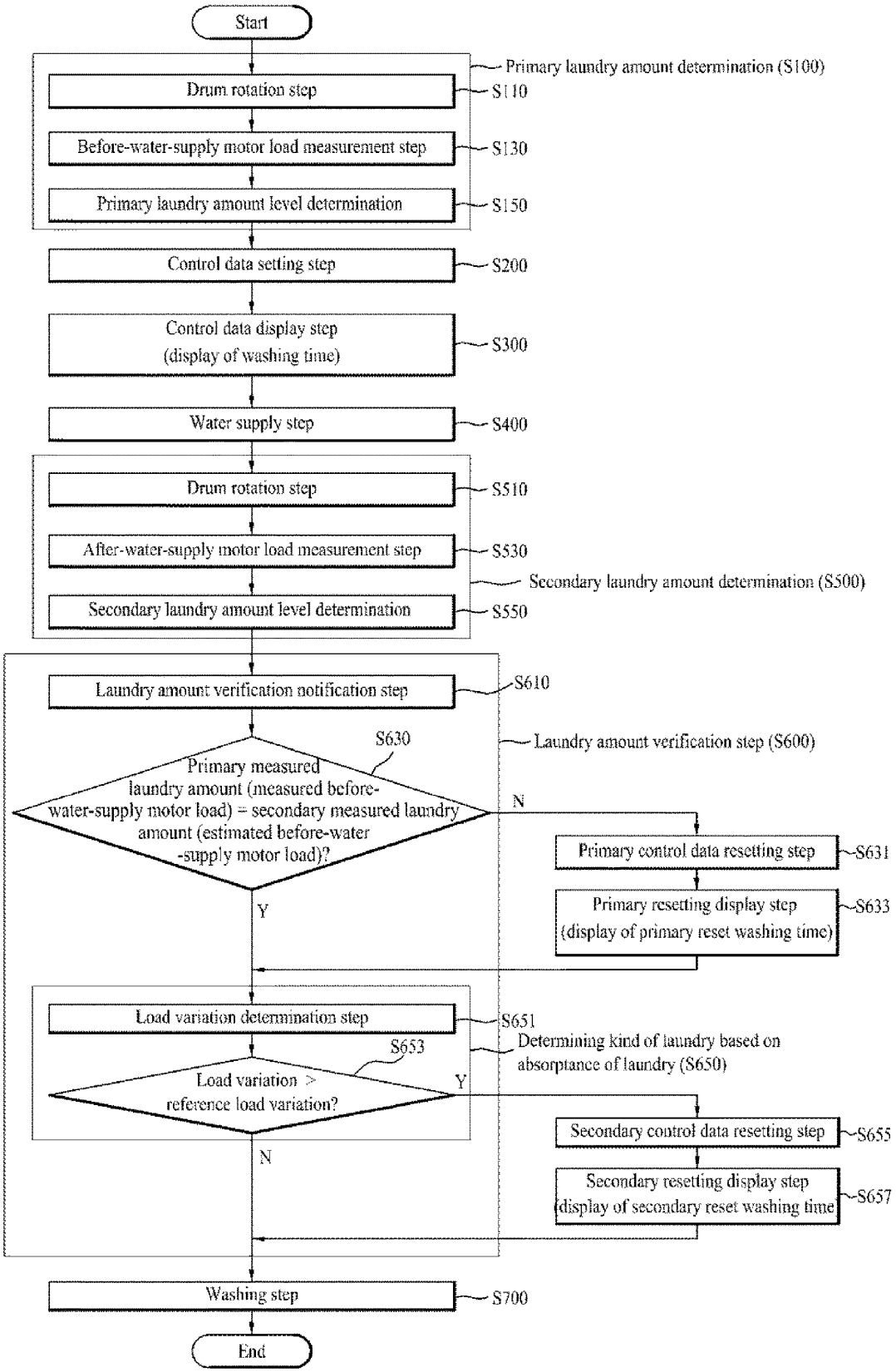

[Fig. 5]
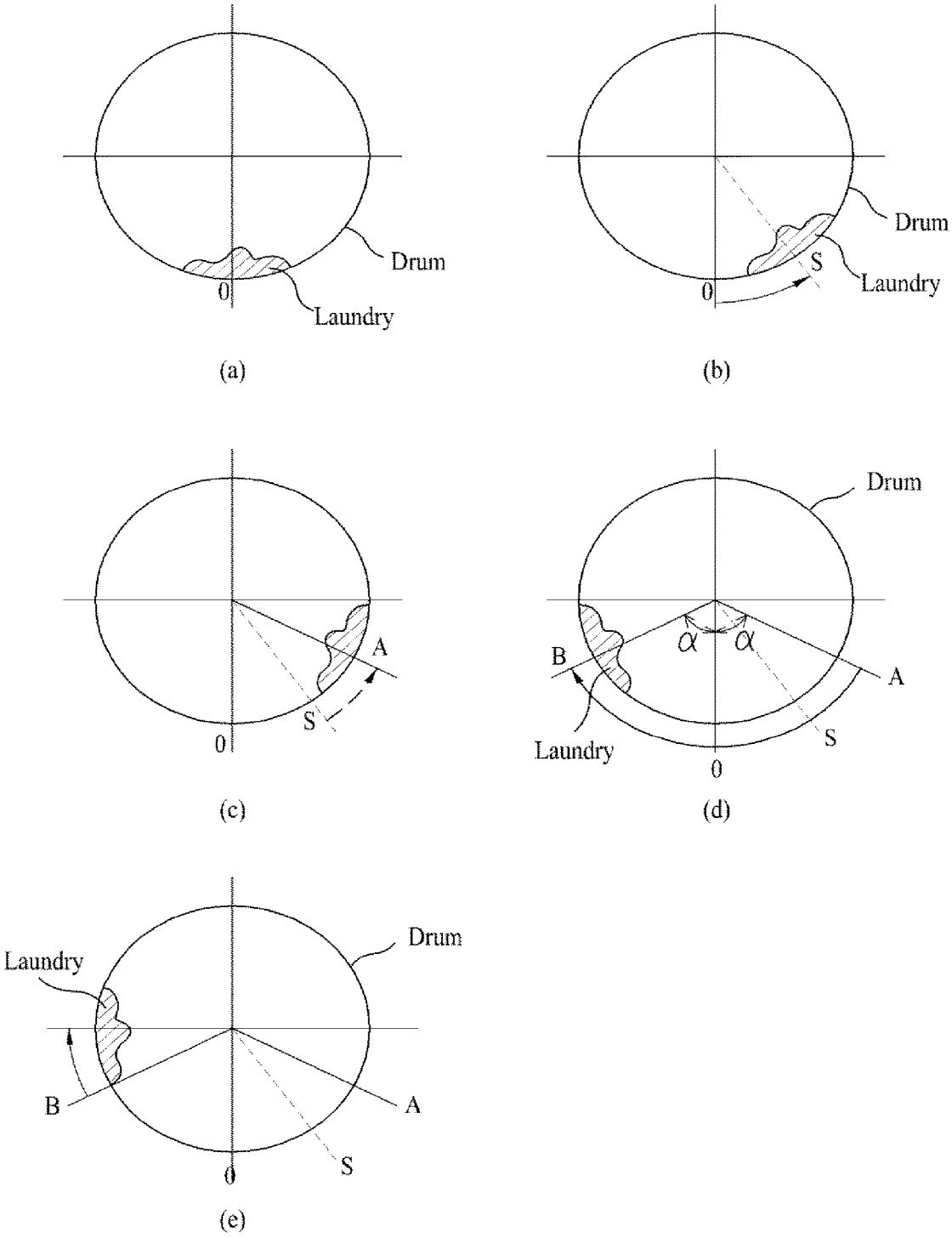

[Fig. 6]
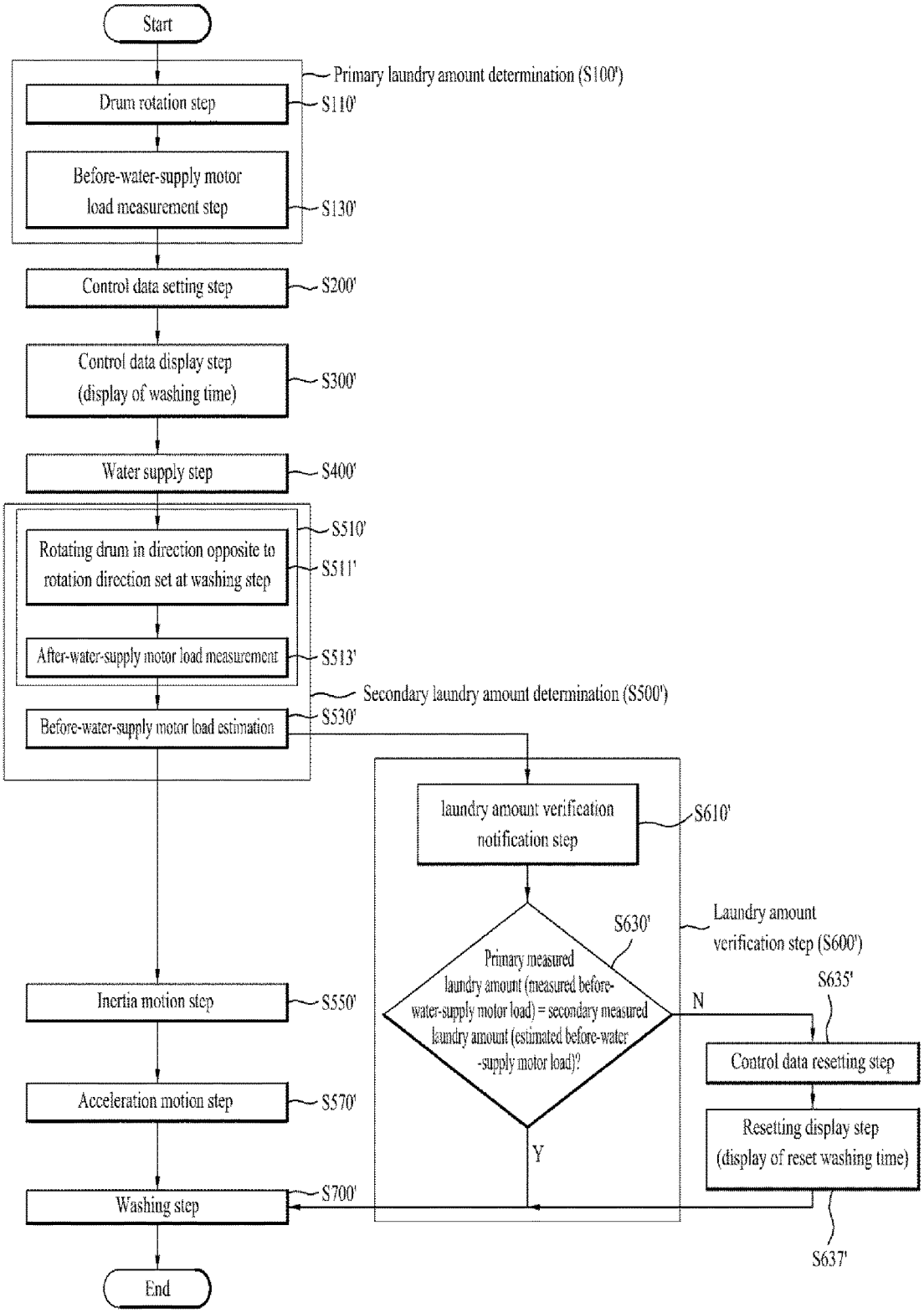

CONTROL METHOD OF WASHING MACHINE

TECHNICAL FIELD

The present invention relates to a control method of a washing machine that is capable of accurately determining the amount of laundry placed in a drum and controlling the washing machine based on the determined amount of laundry.

BACKGROUND ART

Generally, a washing machine is a generic name for electric home appliances that wash, dry, or wash and dry laundry.

The washing machine is mainly classified as an agitator type washing machine, a pulsator type washing machine, or a drum type washing machine.

In the agitator type washing machine, a washing rod vertically mounted in the middle of a washing tub is rotated in alternating directions to wash laundry in the washing tub. In the pulsator type washing machine, a disc type rotary blade mounted at the bottom of a washing tub is rotated in alternating directions to wash laundry using a water stream generated in the washing tub. In the drum type washing machine, a drum, mounted in a tub having wash water contained therein, is rotated to wash the laundry.

The drum type washing machine includes a tub mounted in a cabinet forming the external appearance of the washing machine for containing wash water, a drum mounted in the tub for containing laundry, and a motor and a shaft mounted to the rear of the tub for rotating the drum.

Upon commencement of washing in the drum type washing machine with the above-stated construction, the amount of laundry (hereinafter, referred to as 'laundry amount') placed in the drum is determined, and control data necessary to control the washing machine are set. That is, the amount of wash water to be supplied, the amount of detergent necessary, an actual operation ratio of the motor, and operation time of the washing machine are set based on the laundry amount.

When the laundry amount is incorrectly determined, incorrect control data are set, and the washing machine is operated based on the incorrect control data. For the washing machine, therefore, determination of the laundry amount is very important.

DISCLOSURE OF INVENTION

Technical Problem

An object of the present invention devised to solve the problem lies on a control method of a washing machine that is capable of accurately determining the amount of laundry placed in a drum.

Another object of the present invention devised to solve the problem lies on a control method of a washing machine that is capable of verifying whether the measured amount of laundry is accurate and correcting control data necessary to operate the washing machine based on the verified amount of laundry.

A further object of the present invention devised to solve the problem lies on a control method of a washing machine that is capable of determining kind of laundry classified based on absorptance and correcting control data set based on the amount of laundry to control data based on the kind of laundry.

Solution to Problem

The object of the present invention can be achieved by providing a control method of a washing machine including a tub for containing wash water, a drum rotatably mounted in the tub for containing laundry, and a motor for rotating the drum, the control method including a primary laundry amount determination step of measuring the amount of the laundry placed in the drum before supplying wash water to the tub, a data setting step of setting control data necessary to control the washing machine based on the amount of the laundry measured at the primary laundry amount determination step, a secondary laundry amount determination step of measuring the amount of the laundry placed in the drum after supplying wash water to the tub, and a data resetting step of resetting the control data based on the amount of the laundry determined at the secondary laundry amount determination step when the amount of the laundry measured at the primary laundry amount determination step is different from the amount of the laundry measured at the secondary laundry amount determination step.

The primary laundry amount determination step may include rotating the drum to a predetermined reference angle to measure before-water-supply motor load, the secondary laundry amount determination step may include rotating the drum to the reference angle to measure after-water-supply motor load and estimating before-water-supply motor load from the measured after-water-supply motor load, and the data resetting step may include resetting the control data based on the before-water-supply motor load estimated at the secondary laundry amount determination step when the before-water-supply motor load measured at the primary laundry amount determination step is different from the before-water-supply motor load estimated at the secondary laundry amount determination step.

The secondary laundry amount determination step may include comparing the after-water-supply motor load measured at the secondary laundry amount determination step with motor load data to estimate the before-water-supply motor load from the measured after-water-supply motor load, and the motor load data is a variation value of arbitrary before-water-supply motor load after supplying wash water to the tub.

The primary laundry amount determination step may include determining a laundry amount level to which the measured before-water-supply motor load belongs among a before-water-supply laundry amount level having an upper limit and a lower limit of the motor load, the secondary laundry amount determination step may include determining a laundry amount level to which after-water-supply motor load measured from an after-water-supply laundry amount level having an upper limit variation value and a lower limit variation value of the before-water-supply laundry amount level as an upper limit and a lower limit when a predetermined amount of wash water is supplied to the tub belongs, and the data resetting step may include resetting the control data based on a secondary laundry amount level measured at the secondary laundry amount determination step when a primary laundry amount level measured at the primary laundry amount determination step is different from the secondary laundry amount level measured at the secondary laundry amount determination step.

The primary laundry amount determination step may include measuring electric current supplied to the motor so as to rotate the drum to the reference angle to measure the before-water-supply motor load, and the secondary laundry amount determination step may include measuring electric current supplied to the motor so as to rotate the drum to the reference angle to measure the after-water-supply motor load.

The control method may further include a resetting display step of displaying the control data reset at the data resetting step at an outside of the washing machine.

The control method may further include a resetting display step of displaying the control data set at the data setting step at the outside of the washing machine.

The control method may further include a laundry amount verification step of determining whether the before-water-supply motor load measured at the primary laundry amount determination step is equal to the before-water-supply motor load estimated at the secondary laundry amount determination step, the laundry amount verification step being performed before the data resetting step, and a laundry amount verification notification step of notifying a user that the laundry amount verification step is in progress.

The control method may further include a step of determining kind of the laundry based on absorptance of the laundry using load variation, which is a difference between the before-water-supply motor load and the after-water-supply motor load, and a secondary resetting step of changing the control data reset at the data resetting step to control data previously set based on the kind of the laundry.

The control method may further include a step of determining load variation, which is a difference between the before-water-supply motor load and the after-water-supply motor load, and a secondary resetting step of changing the control data reset at the data resetting step to control data previously set to wash laundry exhibiting high absorptance when the load variation is equal to or greater than predetermined reference load variation.

The control method may further include a secondary resetting display step of displaying the control data reset at the secondary resetting step at an outside of the washing machine.

The control data may include an actual operation ratio defined as a ratio of motor ON time to the sum of motor ON time and motor OFF time.

The control data may include operation time of the washing machine.

The control method may further include a washing step of rotating the drum in a predetermined rotation direction, the washing step being performed after the data resetting step.

The control method may further include an observation motion step of rotating the drum to the reference angle in a direction opposite to the rotation direction set at the washing step to measure electric current supplied to the motor, the observation motion step being performed before the washing step, and an acceleration motion step of rotating the drum in a direction identical to the rotation direction set at the washing step.

The after-water-supply motor load measured at the secondary laundry amount determination step may be obtained by measuring the electric current supplied to the motor so as to rotate the drum to the reference angle at the observation motion step.

The acceleration motion step may include supplying electric current of the same magnitude as the electric current measured at the observation motion step to the motor.

The control method may further include an inertia motion step of stopping supply of the electric current to the motor, when the drum is rotated to the reference angle, such that the drum is rotated by inertia, the inertia motion step being performed between the observation motion step and the acceleration motion step.

Advantageous Effects of Invention

According to the present invention, it is possible to provide a control method of a washing machine that is capable of accurately determining the amount of laundry placed in a drum.

Also, it is possible to provide a control method of a washing machine that is capable of verifying whether the measured amount of laundry is accurate and correcting control data necessary to operate the washing machine based on the verified amount of laundry.

Also, it is possible to provide a control method of a washing machine that is capable of determining kind of laundry classified based on absorptance and correcting control data set based on the amount of laundry to control data based on the kind of laundry.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view of a washing machine.

FIG. 2 is a flow chart illustrating a control method of a washing machine according to an embodiment of the present invention.

FIG. 3 is a flow chart illustrating a control method of a washing machine according to another embodiment of the present invention.

FIG. 4 is a flow chart illustrating a control method of a washing machine according to a further embodiment of the present invention.

FIGS. 5A to 5E are conceptual views of a preceding motion step.

FIG. 6 is a flow chart illustrating a control method of a washing machine including a preceding motion step.

BEST MODE FOR CARRYING OUT THE INVENTION

Reference will now be made in detail to the preferred embodiments of the present invention, examples of which are illustrated in the accompanying drawings.

All terms disclosed in this specification correspond to general terms understood by persons having ordinary skill in the art to which the present invention pertains unless the terms are specially defined. If terms disclosed in this specification conflict with general terms, the terms may be understood on the basis of their meanings as used in this specification.

Meanwhile, constructions or control methods of an apparatus, which will be described hereinafter, are disclosed only to describe embodiments of the present invention, and therefore, the scope of the present invention is not limited thereby. Wherever possible, the same reference numbers will be used throughout the drawings to refer to the same or like parts.

FIG. 1 is a perspective view of a washing machine to which embodiments of the present invention may be applied.

The washing machine includes a cabinet 110 forming the external appearance of the washing machine, a tub 120 mounted in the cabinet 110 such that the tub 120 is supported by the cabinet 110, a drum 130 rotatably mounted in the tub 120 for allowing laundry to be introduced thereinto, a motor 140 for applying torque to the drum 130 to rotate the drum 130, and a control panel 115 for allowing a user to select and perform a washing course.

The cabinet 110 includes a main body 111, a cover 112 coupled to the front of the main body 111, and a top plate 116 coupled to the top of the main body 111. The cover 112 may include an opening 114 for allowing laundry to be introduced and removed therethrough and a door 113 for selectively opening and closing the opening 114.

The drum 130 is rotated by electric power transmitted from the motor 140. The drum 130 has a plurality of through holes 131, through which wash water in the tub 120 may be introduced into the drum 130 and through which wash water in the drum 130 may be discharged to the tub 120. Upon rotation of the drum 130, therefore, laundry in the drum 130 collides with the wash water in the tub 120, with the result that dirt is removed from the laundry. Meanwhile, the drum may further include lifters 135 for lifting the laundry.

The control panel 115 allows a user to input information related to washing and, in addition, to confirm information related to washing. That is, the control panel 115 is an interface between the user and the washing machine. Specifically, the control panel 115 includes operation unit 117 and 118 for allowing a user to input a control command and a display part 119 for displaying control information based on the control command. Also, the control panel 115 may further include a controller (not shown) for controlling the operation of the washing machine, including the operation of the motor, according to the control command.

FIG. 2 is a flow chart illustrating a control method of a washing machine according to an embodiment of the present invention.

In the control method of the washing machine according to this embodiment, a primary laundry amount determination step (S10), including a drum rotation step (S11) of rotating the drum to a predetermined reference angle before supplying wash water to the tub and a before-water-supply motor load measurement step (S13) of measuring load of the motor at the drum rotation step (S11), is performed. Namely, the before-water-supply motor load measurement step (S13) is a step for measuring load of the motor before supplying wash water to the tub.

Load applied to the motor is proportional to the amount of laundry placed in the drum. Consequently, the amount of laundry placed in the drum may be determined by comparison between laundry amount data based on load of the motor measured through experimentation and load of the motor measured at the before-water-supply motor load measurement step (S13). In this case, load of the motor before supplying wash water to the tub may be measured based on the magnitude of electric current supplied to the motor so as to rotate the drum to the reference angle or based on time necessary for the drum to be rotated to the reference angle. Alternatively, load of the motor before supplying wash water to the tub may be measured based on the rotation velocity of the drum.

After the amount of laundry placed in the drum is determined at the primary laundry amount determination step (S10), a control data setting step (S20) of setting control data necessary to operate the washing machine is performed.

The control data are data set to control the washing machine. For example, the control data may include a washing time set based on the amount of laundry an actual operation ration (a net acting ration) defined as a ratio of motor ON time to the sum of motor ON time and motor OFF time, a drum motion defined as a movement pattern of laundry in the drum classified based on rotation direction and velocity of the drum, and the amount of wash water necessary to wash laundry.

A user may be notified of data set based on the amount of laundry through the display part 119 (see FIG. 1) (S30). When washing time, one of the control data, is displayed on the outside of the washing machine, it is possible to estimate time necessary to wash laundry, thereby improving user convenience. That is, the control data display step (S30) preferably includes a step of display control data, such as washing time, to improve user convenience.

The control data display step (S30) continues to be performed until washing is completed by the washing machine. At this time, remaining washing time may be displayed during washing. Upon completion of the control data display step (S30), a water supply step (S40) of supplying wash water to the tub is performed. However, the water supply step (S40) may be performed even before the control data display step (S30) as long as the level of wash water is decided at the control data setting step (S20). Consequently, the water supply step (S40) does not need to be performed after the control data display step (S30) or during the control data display step (S30).

In a case in which the washing machine is configured such that the amount of laundry is determined only through the primary laundry amount determination step (S10) to set the control data, it is not possible to accurately sense the amount of wet laundry when such wet laundry is placed in the drum.

Even if a uniform amount of laundry is placed in the drum, load of the motor when dry laundry is placed in the drum may be different from load of the motor when wet laundry is placed in the drum.

That is, the weight of wet laundry is the sum of the weight of dry laundry and the weight of water absorbed by the dry laundry. Although a uniform amount of laundry is placed in the drum, therefore, load of the motor measured when dry laundry is placed in the drum may be different from load of the motor measured when wet laundry is placed in the drum. When wet laundry is placed in the drum, control data necessary to wash the amount of laundry greater than the actual amount of laundry is set at the control data setting step (S20), with the result that it is not possible to perform optimal control based on the amount of laundry (the amount of wash water is increased, washing time is increased, and power consumption necessary to wash laundry is increased).

In order to solve the problem due to incorrect laundry amount detection as described above, the control method of the washing machine according to this embodiment further includes a secondary laundry amount determination step (S50), which is performed after wash water is supplied into the tub, and a laundry amount verification step (S60) of comparing the amount of laundry measured at the secondary laundry amount determination step (S50) with the amount of laundry measured at the primary laundry amount determination step (S10) to verify the amount of laundry measured at the primary laundry amount determination step (S10).

The secondary laundry amount determination step (S50) may include a drum rotation step (S51) of rotating the drum to the reference angle after supplying wash water to the tub according to the control data set at the control data setting step (S20), an after-water-supply motor load measurement step (S53) of measuring load of the motor at the drum rotation step (S51, the after-water-supply motor load measurement step is a step to measure a load of the motor after supplying wash water to the tub), and a before-water-supply motor load estimation step (S55) of estimating load of the motor before supplying wash water to the tub from the load of the motor measured at the after-water-supply motor load measurement step (S53).

The after-water-supply motor load measurement step (S53) may be performed based on electric current supplied to the motor during the drum rotation step (S51). The after-water-supply motor load measurement step is performed after wash water is supplied to the tub, and therefore, the after-water-supply motor load is greater than the before-water-supply motor load.

Meanwhile, the before-water-supply motor load estimation step (S55) of estimating load of the motor before supplying wash water to the tub from the load of the motor measured at the after-water-supply motor load measurement step may be performed based on experimental data of before-water-supply motor load and after-water-supply motor load with respect to a specific amount of laundry.

That is, load of the motor is measured after laundry is introduced into the drum and before water is supplied to the tub, and load of the motor is measured after water is supplied to the tub. Experimental data obtained through the measurement are stored in the washing machine. Consequently, it is possible to estimate before-water-supply motor load by comparing load of the motor measured at the after-water-supply motor load measurement step (S53) with the stored experimental data.

The secondary laundry amount determination step (S50) includes the before-water-supply motor load estimation step (S55) of estimating before-water-supply motor load from after-water-supply motor load in order to verify the amount of laundry through direct comparison with the before-water-supply motor load measured at the primary laundry amount determination step (S10).

At the secondary laundry amount determination step (S50), the amount of laundry is determined after the water supply step (S40). For this reason, electric current supplied to the motor so as to rotate the drum to the reference angle is measured to determine load of the motor, thereby measuring load of the motor considering load due to wash water. It is difficult to verify the amount of laundry through simple comparison between load of the motor measured at the primary laundry amount determination step and load of the motor measured at the secondary laundry amount determination step. At the secondary laundry amount determination step (S50) of this embodiment, therefore, before-water-supply motor load is estimated from the measured after-water-supply motor load.

However, the before-water-supply motor load estimation step of estimating before-water-supply motor load from after-water-supply motor load is needed only when electric current supplied to the motor so as to rotate the drum to the reference angle is measured to determine load of the motor. In a case in which it is possible to verify the amount of laundry through simple comparison between load of the motor measured at the primary laundry amount determination step and load of the motor measured at the secondary laundry amount determination step, therefore, the before-water-supply motor load estimation step may not be performed.

In this embodiment, the secondary laundry amount determination step (S50) is performed after wash water is supplied to the tub based on the water level set at the control data setting step (S20). Alternatively, the secondary laundry amount determination step (S50) may be performed when wash water is supplied to a predetermined water level of the tub (a water level at which laundry in the drum is sufficiently wetted) during the water supply step (S40).

When the before-water-supply motor load is estimated from the after-water-supply motor load (S55), the laundry amount verification step (S60) of verifying whether the amount of laundry determined at the primary laundry amount determination step is accurate, including a step (S63) of determining whether the before-water-supply motor load measured at the primary laundry amount determination step is equal to the before-water-supply motor load estimated at the secondary laundry amount determination step, is performed.

In this case, the laundry amount verification step (S60) may further include a laundry amount verification notification step (S61). At the laundry amount verification notification step (S61), a user is notified that the verification step for accurately determining the amount of laundry is in progress. The laundry amount verification notification may be displayed on the display part 110.

Conventional washing machines with a laundry amount detection function do not verify whether the amount of laundry measured before supply of water is accurate. As a result, it is not possible for a user to determine whether control data set based on the measured amount of laundry are proper. At the laundry amount verification notification step (S61) according to this embodiment, however, the user is notified that the step (S63) of verifying whether the amount of laundry determined at the primary laundry amount determination step (S10) is accurate is in progress, thereby improving user confidence in the washing machine.

When the before-water-supply motor load measured at the primary laundry amount determination step (S10) is equal to the before-water-supply motor load estimated at the secondary laundry amount determination step, which means that the amount of laundry determined at the primary laundry amount determination step (S10) is accurate, a washing step (S70) is performed based on the control data set at the amount determination step (S10).

In this case, although not shown in the drawing, a step of notifying a user that the amount of laundry determined at the primary laundry amount determination step is accurate through the display part 119 may be included so as to notify the user of the result of the laundry amount verification notification step (S61), thereby improving reliability of the washing machine.

However, when the before-water-supply motor load measured at the primary laundry amount determination step is different from the before-water-supply motor load estimated at the secondary laundry amount determination step, which means that the amount of laundry determined at the primary laundry amount determination step is not accurate as in a case in which wet laundry is placed in the drum, a control data resetting step (S65) is performed.

At the control data resetting step (S65), the control data set at the control data setting step (S20) is corrected based on the before-water-supply motor load (S55) estimated at the secondary laundry amount determination step.

In this embodiment, the control method of the washing machine may further include a step (S67) of notifying a user of the reset control data by displaying the reset control data through the display part 119.

As previously described, the control data may include washing time, an actual operation ration (a net acting ration), a drum motion, a water level, and the like. In FIG. 2, washing time is used as an example of the control data.

FIG. 3 is a flow chart illustrating a control method of a washing machine according to another embodiment of the present invention. This embodiment is different from the embodiment of FIG. 2 in that the control method of washing machine according to this embodiment further includes a step of classifying laundry based on absorptance of the laundry and resetting control data with respect to the classified kinds of laundry.

Laundry exhibits different wash water absorption degrees depending upon kinds of laundry. Generally, laundry absorbing a large amount of wash water needs to be strongly washed as compared with laundry absorbing a small amount of wash water. That is, the amount of supplied wash water is increased for laundry absorbing a large amount of wash water. Also, movement of laundry in the drum (drum motion) needs to be increased such that the laundry can be strongly washed. In addition, it is necessary to increase washing time. In this embodiment, therefore, control data is set based on the amount and kind of laundry, and the washing machine is operated based on the set control data.

Hereinafter, this embodiment will be described with reference to FIG. 3 on the basis of differences from the embodiment of FIG. 2.

In this embodiment, the control method of the washing machine includes a primary laundry amount determination step (S10') of determining the amount of laundry placed in the drum before supplying wash water to the tub. The primary laundry amount determination step (S10') may include a drum rotation step (S11') of rotating the drum to a predetermined reference angle and a before-water-supply motor load measurement step (S13') of measuring electric current supplied to the motor during the drum rotation step (S11').

When the amount of laundry is determined at the primary laundry amount determination step, a control data setting step (S20') of setting control data based on the determined amount of laundry, a control data display step (S30') of notifying a user of washing time, which is related to user convenience, or the like, and a water supply step (S40') of supplying wash water to the tub are sequentially performed.

When the wash water is supplied to a predetermined water level of the tub, a secondary laundry amount determination step (S50') is performed. The secondary laundry amount determination step (S50') includes a drum rotation step (S51') of rotating the drum to the reference angle, an after-water-supply motor load measurement step (S53'), and a before-water-supply motor load estimation step (S55'). These steps are identical to those of the embodiment shown in FIG. 2, and therefore, a detailed description thereof will not be given.

Upon completion of the secondary laundry amount determination step, a laundry amount verification step (S60') of determining whether the amount of laundry determined at the primary laundry amount determination step is equal to the amount of laundry determined at the secondary laundry amount determination step is performed.

When the amount of laundry determined at the primary laundry amount determination step is equal to the amount of laundry determined at the secondary laundry amount determination step, a step (S65') of determining kind of laundry based on absorptance of the laundry is performed. In this case, although not shown in the drawing, the step (S65') of determining kind of laundry based on absorptance of the laundry may be performed after a step of notifying a user that the step of determining kind of laundry is in progress.

On the other hand, when the amount of laundry determined at the primary laundry amount determination step is different from the amount of laundry determined at the secondary laundry amount determination step, a primary control data resetting step (S631') and a primary resetting display step (S633') are performed, and then the step (S65') of determining kind of laundry based on absorptance of the laundry is performed.

The step (S65') of determining kind of laundry based on absorptance of the laundry is performed using load variation defined as the difference between the after-water-supply motor load measured at the secondary laundry amount determination step and the before-water-supply motor load measured at the primary laundry amount determination step. In a case in which the measurement of motor load at the primary laundry amount determination step and at the secondary laundry amount determination step is performed based on electric current supplied to the motor, therefore, the load variation may be defined as the difference between electric current supplied to the motor so as to rotate the drum to the reference angle after supplying water to the tub and electric current supplied to the motor so as to rotate the drum to the reference angle before supplying water to the tub.

The load variation is determined at a load variation determination step (S651'). When the load variation is determined, the load variation is compared with predetermined reference load variation (S653') to determine kind of laundry based on absorptance of the laundry.

When the amount of dry laundry placed in the drum is uniform, the before-water-supply motor load measured at the primary laundry amount determination step is uniform irrespective of kind of laundry based on absorptance of the laundry. However, the secondary laundry amount determination step is performed after the water supply step (S40'), with the result that the after-water-supply motor load is changed depending upon kind of laundry based on absorptance of the laundry. That is, the after-water-supply motor load with respect to laundry exhibiting high absorptance may be greater than the after-water-supply motor load with respect to laundry exhibiting low absorptance. Consequently, it is possible to determine whether laundry placed in the drum exhibits high absorptance or low absorptance by measuring the load variation defined as the difference between the after-water-supply motor load and the before-water-supply motor load.

Meanwhile, the reference load variation may be defined as the difference between after-water-supply motor load and before-water-supply motor load based on each kind of laundry. In this case, it is preferred that the reference load variation is provided the washing machine by a manufacturer. The reference load variation may be set such that kind of laundry, control data of which need to be differently set so as to secure washing performance of the washing machine, is pre-selected by the manufacturer, and data of load variation of the selected laundry are stored in the washing machine.

In this case, the reference load variation may have an upper limit and a lower limit. Also, the reference load variation may have a plurality of reference load variation sections divided depending upon kind of laundry. Consequently, it is possible to determine kind of laundry by determining a section to which the measured load variation belongs among the reference load variation sections divided depending upon kind of laundry. Control data suitable for corresponding kind of laundry are set with respect to the respective reference load variation sections. In the control method according to this embodiment, therefore, it is possible to set control data based on kind of laundry by comparing the load variation with the reference load variation.

Alternatively, the reference load variation may not have the reference load variation sections set differently based on kind of laundry, but load variation of laundry having a critical meaning necessary to change control data so as to secure washing performance may be set as the reference load variation. That is, critical load variation at which the washing performance is maintained even when the washing machine is operated using control data based on the amount of laundry may be set as the reference load variation. In this case, when the load variation is equal to or greater than the reference load variation, control data need to be changed so as to provide strong washing force with respect to laundry. On the other hand, when the load variation is less than the reference load variation, the washing step is performed without changing the control data set at the control data setting step (S20') or at the primary control data resetting step (S631').

When it is determined that the control data do not need to be changed as a result of the comparison between the load variation and the reference load variation, a washing step (S70') is performed based on the control data set at the control data setting step (S20') or at the primary control data resetting step (S631'). On the other hand, when it is determined that the control data need to be changed as a result of the comparison between the load variation and the reference load variation, the control data are reset through a secondary control data resetting step (S655'), and washing is performed based on the reset control data. In this case, a secondary resetting display step (S657') may be further performed after the secondary control data resetting step so as to improve user confidence in the washing machine.

FIG. 4 is a flow chart illustrating a control method of a washing machine according to a further embodiment of the present invention. This embodiment is different from the previous embodiments in that the amount of laundry placed in the drum is determined using a laundry amount level at the primary laundry amount determination step and the secondary laundry amount determination step.

In this embodiment, a step (S650) of determining kind of laundry based on absorptance of the laundry may be omitted as in the embodiment shown in FIG. 2. However, the control method of a washing machine including the step (S650) of determining kind of laundry based on absorptance of the laundry will be described for the convenience of description.

A primary laundry amount determination step (S100) may include a drum rotation step (S110) of rotating the drum to a predetermined reference angle in one direction, a before-water-supply motor load measurement step (S130), and a primary laundry amount level determination step (S150) of determining a laundry amount level based on the measured motor load.

At the before-water-supply motor load measurement step (S130), the magnitude of electric current supplied to the motor so as to rotate the drum to the reference angle set at the drum rotation step may be measured.

Load applied to the motor is proportional to the amount of laundry placed in the drum. Also, the amplitude of electric current supplied to the motor is proportional to load of the motor. Consequently, it is possible to determine the amount of laundry placed in the drum from the measured value of electric current if data of electric current supplied to the motor so as to rotate the drum to the reference angle based on the amount of laundry are experimentally secured. Of course, it is possible to determine load of the motor by measuring time necessary to rotate the drum to the reference angle or measuring rotation velocity of the drum, as previously described. In the latter case, however, it is necessary to experimentally secure time data and rotation velocity data based on the amount of laundry.

At the primary laundry amount level determination step (S150), a laundry amount level to which load of the motor measured at the before-water-supply motor load measurement step (S130) belongs is determined from laundry amount level data (before-water-supply laundry amount level data) set in the washing machine. The before-water-supply laundry amount level data are obtained by dividing a laundry amount range, in which control data, such as an actual operation ratio (a net acting ratio), a drum motion, and washing time, need to be changed so as to exhibit desired washing performance of the washing machine, into a plurality of laundry amount levels and converting the laundry amount range, which is a basis of laundry amount level division, to the upper limit and the lower limit of the motor load.

After the laundry amount level of laundry placed in the drum is determined at the primary laundry amount determination step (S100), a control data setting step (S200) of setting control data based on the measured laundry amount level is performed. In addition, it is preferable to notify a user of washing time, which is related to user convenience, among the control data set based on the laundry amount level at a control data display step (S300).

The washing time may be defined as operation time of the washing machine necessary when a washing course selected by the user is performed. That is, when a washing course, including a washing cycle, a rinsing cycle, a spin-drying cycle, and a drying cycle, is performed, the washing time is the sum of time necessary to perform the respective cycles. In a washing machine having no drying function, on the other hand, the washing time may be the sum of time necessary to perform the washing cycle, the rinsing cycle, and the spin-drying cycle.

Meanwhile, the washing time may mean individual time necessary to perform each cycle. That is, washing cycle time, rinsing cycle time, and spin-drying cycle time may be individually set based on the laundry amount level at the control data display step, and time necessary to perform the respective cycles may be displayed at the control data display step (S300).

Meanwhile, in a case in which the washing machine is configured such that the laundry amount level is determined only through the primary laundry amount determination step (S100), it is not possible to accurately sense the amount of wet laundry when such wet laundry is placed in the drum.

Generally, data (laundry amount level data) set in the washing machine so as to determine the amount of laundry is set based on a condition that dry laundry is placed in the drum. When wet laundry is placed in the drum, therefore, the conventional washing machine may incorrectly determine the amount of laundry.

That is, the weight of wet laundry is the sum of the weight of dry laundry and the weight of water absorbed by the dry laundry. When wet laundry is placed in the drum, therefore, the conventional washing machine may incorrectly assume that an amount of dry laundry greater than the actual amount of the dry laundry is placed in the drum. As a result, the amount of wash water is increased, washing time is increased, and power consumption necessary to wash laundry is increased.

In order to prevent incorrect laundry amount detection as described above, the control method of the washing machine according to this embodiment further includes a secondary laundry amount determination step (S500), which is performed after a water supply step (S400), and a laundry amount verification step (S600) of comparing the laundry amount level measured at the secondary laundry amount determination step (S500) with the laundry amount level measured at the primary laundry amount determination step (S100) to verify the laundry amount level measured at the primary laundry amount determination step (S100).

The amount of wash water supplied at the water supply step (S400) may be set based on the amount of wash water according to the laundry amount level measured at the primary laundry amount determination step (S100). In this embodiment, the water supply step (S400) is performed after the control data display step (S300). However, the water supply step and the control data display step may be performed simultaneously, or the water supply step may be performed even before the control data display step, as long as the level of water to be supplied is decided at the control data setting step (S200).

On the other hand, laundry is soaked in the supplied water, and then the amount of wet laundry is determined at the secondary laundry amount determination step (S500). Consequently, the secondary laundry amount determination step may be performed during the water supply step (S400). The secondary laundry amount determination step (S500) may include a drum rotation step (S510) of rotating the drum to the reference angle, an after-water-supply motor load measurement step (S530), and a secondary laundry amount level determination step (S550).

At the drum rotation step (S510), the drum is rotated to the same reference angle as at the drum rotation step of the primary laundry amount determination step (S100). At the after-water-supply motor load measurement step (S530), the magnitude of electric current supplied to the motor so as to rotate the drum to the reference angle is determined. At the secondary laundry amount level determination step (S550), the laundry amount level is determined using load of the motor measured after the supply of water.

For the same dry laundry, however, laundry amount level data (after-water-supply laundry amount level data) necessary to perform the secondary laundry amount level determination step (S550) is preferably provided such that the laundry amount level measured at the primary laundry amount level determination step is equal to the laundry amount level measured at the secondary laundry amount level determination step.

That is, the after-water-supply laundry amount level data include the same number of laundry amount levels as the before-water-supply laundry amount level data, and, when a predetermined amount of wash water is supplied to the tub, the upper limit and the lower limit of the after-water-supply laundry amount level data are preferably set to the upper limit and the lower limit of the before-water-supply laundry amount level data.

At a laundry amount verification step (S600), which will be described hereinafter, therefore, it is possible to simply compare the laundry amount level determined at the primary laundry amount determination step (S100) with the laundry amount level determined at the secondary laundry amount determination step.

Upon completion of the secondary laundry amount determination step (S500), the laundry amount verification step (S600) is performed to determine whether the laundry amount level determined at the primary laundry amount determination step (S100) is accurate. The laundry amount verification step (S600) may include a laundry amount verification notification step (S610) and a laundry amount level comparison step (S630).

At the laundry amount verification notification step (S610), a user is notified that the verification step for accurately determining the amount of laundry is in progress. The laundry amount verification notification may be displayed on the display part 110 (see FIG. 1), thereby improving user confidence in the washing machine.

At the laundry amount level comparison step (S630), the laundry amount level (primary laundry amount level) determined at the primary laundry amount determination step (S100) is compared with the laundry amount level (secondary laundry amount level) determined at the secondary laundry amount determination step (S500).

When the primary laundry amount level is equal to the secondary laundry amount level, which means that the amount of laundry determined at the primary laundry amount determination step (S100) is accurate, it is not necessary to correct the control data (washing time and the like) set based on the amount of laundry. However, when the primary laundry amount level is different from the secondary laundry amount level, which means that the amount of laundry is incorrectly determined at the primary laundry amount determination step (S100), it is necessary to correct the control data (washing time and the like) set based on the amount of laundry.

That is, when the primary laundry amount level is equal to the secondary laundry amount level, a washing step (S700) is performed. On the other hand, when the primary laundry amount level is different from the secondary laundry amount level, it is necessary to correct the control data set based on the primary laundry amount level. Consequently, a primary control data resetting step (S631) and a primary resetting display step (S633) are performed, and then the washing step (S700) is performed.

Consequently, the present invention provides a control method of a washing machine that is capable of accurately measuring the amount of laundry placed in the drum and of resetting control data, when the amount of laundry is incorrectly determined, and then performing a washing step, thereby achieving optimal control based on the amount of laundry.

In this embodiment, the control method of the washing machine may further include a step (S650) of determining kind of laundry based on absorptance of the laundry.

At the step (S650) of determining kind of laundry based on absorptance of the laundry, kind (texture) of laundry placed in the drum is determined. Based on kinds of laundry, the laundry may be classified as laundry which needs to be strongly washed or laundry which can be washed using small washing force.

Generally, it is preferable to wash laundry (jumpers etc.) absorbing a large amount of wash water for a long washing time or using a drum motion providing large washing force. On the other hand, it is preferable to wash laundry absorbing a small amount of wash water for a short period of washing time or using a drum motion providing small washing force.

Consequently, the control method according to this embodiment determines whether control data need to be changed based on kind of laundry, thereby washing laundry using control data optimized based on kind of laundry.

The step (S650) of determining kind of laundry based on absorptance of the laundry is performed using load variation defined as the difference between the after-water-supply motor load measured at the secondary laundry amount determination step and the before-water-supply motor load measured at the primary laundry amount determination step. In a case in which the measurement of motor load at the primary laundry amount determination step and at the secondary laundry amount determination step is performed based on electric current supplied to the motor, therefore, the load variation may be defined as the difference between electric current supplied to the motor so as to rotate the drum to the reference angle after supplying water to the tub and electric current supplied to the motor so as to rotate the drum to the reference angle before supplying water to the tub.

The load variation is determined at a load variation determination step (S651). When the load variation is determined, the load variation is compared with predetermined reference load variation (S653) to determine kind of laundry based on absorptance of the laundry.

When the amount of dry laundry placed in the drum is uniform, the before-water-supply motor load measured at the primary laundry amount determination step is uniform irrespective of kind of laundry based on absorptance of the laundry. However, the secondary laundry amount determination step is performed after the water supply step, with the result that the after-water-supply motor load is changed depending upon kind of laundry based on absorptance of the laundry. That is, the after-water-supply motor load with respect to laundry exhibiting high absorptance may be greater than the after-water-supply motor load with respect to laundry exhibiting low absorptance. Consequently, it is possible to determine whether laundry placed in the drum exhibits high absorptance or low absorptance by measuring the load variation defined as the difference between the after-water-supply motor load and the before-water-supply motor load.

Meanwhile, the reference load variation may be defined as the difference between after-water-supply motor load and before-water-supply motor load based on each kind of laundry. In this case, it is preferred that the reference load variation is provided to the washing machine by a manufacturer. The reference load variation may be set such that kind of laundry, control data of which need to be differently set so as to secure washing performance of the washing machine, is pre-selected by the manufacturer, and data of load variation of the selected laundry are stored in the washing machine.

In this case, the reference load variation may have an upper limit and a lower limit. Also, the reference load variation may have a plurality of reference load variation sections divided depending upon kind of laundry. Consequently, it is possible to determine kind of laundry by determining a section to which the measured load variation belongs among the reference load variation sections divided depending upon kind of laundry. Control data suitable for corresponding kind of laundry are set with respect to the respective reference load variation sections. In the control method according to this embodiment, therefore, it is possible to set control data based on kind of laundry by comparing the load variation with the reference load variation.

Alternatively, the reference load variation may not have the reference load variation sections set differently based on kind of laundry, but load variation of laundry having a critical meaning necessary to change control data so as to secure washing performance may be set as the reference load variation. That is, critical load variation at which the washing performance is maintained even when the washing machine is operated using control data based on the amount of laundry may be set as the reference load variation. In this case, when the load variation is equal to or greater than the reference load variation, control data need to be changed so as to provide strong washing force with respect to laundry. On the other hand, when the load variation is less than the reference load variation, the washing step is performed without changing the control data set at the control data setting step (S200) or at the primary control data resetting step (S631).

When it is determined that the control data do not need to be changed as a result of the comparison between the load variation and the reference load variation (S653), the washing step (S700) is performed based on the control data set at the control data setting step (S200) or at the primary control data resetting step (S631).

On the other hand, when it is determined that the control data need to be changed as a result of the comparison between the load variation and the reference load variation, the control data are reset through a secondary control data resetting step (S655), and washing is performed based on the reset control data. In this case, a secondary resetting display step (S657) may be further performed after the secondary control data resetting step so as to improve user confidence in the washing machine.

Meanwhile, the step of determining kind of laundry to reset control data may be performed after the laundry amount comparison step (S630). Alternatively, the step of determining kind of laundry to reset control data may be performed independently of the laundry amount comparison step.

In this case, the laundry amount comparison step (S630), the primary control data resetting step (S631), and the primary resetting display step (S633) are omitted, and therefore, the secondary control data resetting step and the secondary resetting display step may be performed according to the results of the load variation determination step (S651) and the comparison between the load variation and the reference load variation (S653). In addition, it is preferable to notify a user that the step of determining the kind of laundry is in progress through the display part at the laundry amount verification notification step (S610).

FIGS. 5A to 5E are conceptual views of a preceding motion step, which is performed before a drum motion set at a washing step, and FIG. 6 is a flow chart illustrating a control method of a washing machine when a preceding motion step is performed before a washing step.

Hereinafter, a preceding motion step, which is performed before a washing step including a drum motion, will be described first, and then a control method of a washing machine will be described with reference to FIG. 6.

As previously described, the drum motion means a movement pattern, during execution of which laundry in the drum is moved by controlling rotation direction and velocity of the drum.

When the rotation direction and velocity of the drum are controlled, the point of time when laundry is dropped in the drum, the direction in which the laundry is dropped, and the distance that the laundry falls are changed. In a case in which the washing machine is configured to have various drum motions, therefore, friction between laundry articles, friction between laundry and wash water, and drop impact of laundry may be changed according to the drum motions.

When a control method of a washing machine having various drum motions is provided, therefore, it is possible to wash laundry through drum motions that maximize washing efficiency depending upon kind of laundry, a contamination degree of laundry, and the amount of laundry, thereby improving washing performance of the washing machine.

A rolling motion, one of the drum motions, is a motion in which the motor rotates the drum in one direction such that laundry placed on the inner circumference of the drum is dropped to the lowest point of the drum from a position at which the laundry is located below approximately 90 degrees (a motion angle of approximately 90 degrees or less) in the rotational direction of the drum.

A tumbling motion, one of the drum motions, is a motion in which the motor rotates the drum in one direction such that laundry placed on the inner circumference of the drum is dropped to the lowest point of the drum from a position at which the laundry is located between approximately 90 degrees and 110 degrees in the rotational direction of the drum. In the tumbling motion, mechanical force (friction between the laundry, friction between the laundry and washing water, friction between the laundry and the inside circumference surface of the drum etc.) is generated as long as the drum is controlled to be rotated in one direction at an appropriate RPM. Consequently, the tumbling motion is generally used during washing and rinsing.

A step motion, one of the drum motions, is a motion in which the motor rotates the drum in one direction such that laundry placed on the inner circumference of the drum is dropped from the highest point (approximately 180 degrees) of the drum to the lowest point of the drum in the rotational direction of the drum. Consequently, the laundry is raised from the lowest point of the drum in the rotational direction of the drum, and is then dropped from the highest point of the drum to the lowest point of the drum when the drum is stopped by reverse torque generated from the motor. In the step motion, therefore, the laundry is washed by impact force generated while the laundry placed in the drum is dropped with the maximum head. Mechanical force generated in the step motion is greater than the mechanical force generated in the rolling motion or the tumbling motion as previously described.

A swing motion, one of the drum motions, is a motion in which the motor rotates the drum in alternating directions such that laundry is dropped from approximately 90 degrees (a motion angle of approximately 90 degrees in the rotational direction of the drum) in the rotational direction of the drum.

A scrub motion, one of the drum motions, is a motion in which the motor rotates the drum in alternating directions such that laundry is dropped from approximately 90 degrees or more in the rotational direction of the drum (laundry is dropped from a position having a motion angle of 90 degrees or more in the rotational direction of the drum).

Meanwhile, when the drum is immediately rotated at a velocity (rpm) set with respect to each of the drum motions, a current peak may occur at which the amount of electric current supplied to the motor at the beginning of each of the drum motions is abruptly increased.

That is, the drum is stopped in a state in which laundry is placed in the drum before the commencement of a drum motion, and load of the motor is the maximum between the lower point of the drum and 90 degrees in the rotational direction of the drum. In order to rotate the drum at the velocity set with respect to the corresponding drum motion, therefore, it is necessary to supply a large amount of electric current. When the amount of laundry placed in the drum is increased, the amount of electric current to be supplied is increased proportionately.

IF the current peak occurs at the beginning of the drum motion, safety of the washing machine may be affected. When an actual operation ratio (a net acting ration) of the motor is changed so as to secure safety of the washing machine, washing performance of the washing machine is inevitably lowered. For this reason, the washing machine according to this embodiment may further perform a preceding motion step, which is performed before the drum motion.

The preceding motion step is a step of rotating the drum to a predetermined angle in the direction opposite to the rotation direction set with respect to the drum motion and then rotating the drum in the same direction as the rotation direction set with respect to the drum motion.

At the preceding motion step, the drum is rotated in the rotation direction set with respect to the drum motion using potential energy obtained while laundry is rotated in the direction opposite to the rotation direction set with respect to the drum motion. Consequently, it is possible to prevent abrupt increase in amount of electric current supplied at the beginning of the drum motion.

FIGS. 5A to 5E are conceptual views of the preceding motion step. The preceding motion step included in the control method according to the present invention basically includes an observation motion step (FIG. 5B) and an acceleration motion step (FIG. 5D). The preceding motion step may further include an inertia motion step (FIG. 5C), which is performed after the observation motion step, and a conversion motion step (FIG. 5E), which is performed after the acceleration motion step.

FIG. 5A shows a state in which the drum is stopped before the commencement of the drum motion, and FIG. 5B shows an observation motion step of rotating the drum to an observation reference angle S when the drum motion is set to be performed in the clockwise direction.

When the rotation direction set with respect to the drum motion is the clockwise direction, the drum is rotated in the counterclockwise direction at the observation motion step. On the other hand, when the rotation direction set with respect to the drum motion is the counterclockwise direction, the drum is rotated in the clockwise direction at the observation motion step. Hereinafter, it is assumed that the rotation direction set with respect to the drum motion is the clockwise direction for the convenience of description.

At the observation motion step, the drum is rotated to a predetermined reference angle (observation reference angle) S in the counterclockwise direction. The observation reference angle S may be selected in a section of 15 to 45 degrees at which the amount of laundry is effectively detected based on electric current (hereinafter, referred to as "observation motion execution current") supplied to the motor so as to perform the observation motion step. In FIG. 5B, the observation reference angle S is set to 22.5 degrees.

A controller (not shown) of the washing machine controls supply of electric current to the motor such that the drum is rotated to the observation reference angle S. The magnitude of electric current supplied to the motor when the amount of laundry is large is different from the magnitude of electric current supplied to the motor when the amount of laundry is small.

Meanwhile, the maximum value of the observation motion execution current supplied to the motor during the execution of the observation motion step is stored in a storage unit, such as a memory, under the control of the controller. At the acceleration motion step, which will be described later, the controller controls the same magnitude of electric current as the maximum value of the observation motion execution current to be supplied to the motor, which will be described later in detail when the acceleration motion step is discussed.

Upon completion of the observation motion step, the inertia motion step is performed. At the inertia motion step, the supply of electric current to the motor is stopped, when the drum is rotated to the observation reference angle, so as to stop the rotation of the drum.

At the acceleration motion step, which is performed after the inertia motion step, the drum is accelerated using potential energy of laundry obtained through the inertia motion step.

Since the drum is rotated by torque generated from the motor at the observation motion step, the drum and the laundry may rotate by a predetermined angle due to inertia even when the observation motion step is completed. When the inertia motion step is provided after the observation motion step, therefore, it is possible to increase potential energy of the laundry using inertia of the laundry and the drum obtained through the observation motion step without further supply of electric current to the motor. The potential energy obtained by the laundry as the result of the observation motion step is maximized at a position A of the laundry shown in FIG. 5C. At the acceleration motion step (FIG. 5D), which is performed after the inertia motion step, therefore, the drum is rotated in the same direction as the rotation direction set with respect to the drum motion using the potential energy of the laundry. As a result, it is possible to minimize the amount of electric current supplied to the motor in a section in which current peak may occur (between the lowest point O and a specific point B of FIG. 5D).

Meanwhile, the point A at which the potential energy of the laundry to be obtained through the observation motion step is maximized may be detected using a sensing device, such as a Hall effect sensor, mounted at the motor.

From the point S of time when the observation motion step is completed, the supply of electric current to the motor is stopped, with the result that the drum and the laundry may rotate by a predetermined angle in the counterclockwise direction due to inertia generated at the observation motion step. However, when the drum reaches the point A at which the potential energy of the laundry is maximized due to the inertia, the rotation of the drum is stopped, and then the rotation direction of the drum is changed to the clockwise direction. When the Hall effect sensor is provided to detect whether the rotation of the drum is stopped or whether the rotation direction of the drum is changed, therefore, it is possible for the controller to determine whether the laundry reaches the point A at which the potential energy of the laundry is maximized. When the laundry is located at the point A, the controller controls the acceleration motion step shown in FIG. 5D to be executed.

At the acceleration motion step, the maximum value of the observation motion execution current (or a value obtained by amplifying the maximum value of the observation motion execution current at a predetermined rate) is supplied to the motor such that the drum is rotated to a predetermined acceleration reference angle B in the same direction as the rotation direction set with respect to the drum motion.

Preferably, the acceleration reference angle is set to an angle at which the potential energy obtained by the laundry through the observation motion step and the inertia motion step is maximally utilized. FIG. 5D shows an example of the acceleration reference angle set to an angle corresponding to twice an angle between the lowest point O of the drum and the point A at which the potential energy of the laundry is maximized.

That is, the angle between the lowest point O of the drum and the point A at which the potential energy of the laundry is maximized through the inertia motion step is equal to the angle between the lowest point O of the drum and the position B of the drum at which the acceleration motion step is completed so as to maximally utilize the potential energy obtained through the observation motion step and to prevent the occurrence of current peak at which the amount of electric current supplied to the motor is abruptly increased in the section (O-B section) in which load of the motor is maximized.

As previously described in brief, the magnitude of electric current supplied to the motor at the acceleration motion step is equal to the maximum value of the observation motion execution current supplied to the motor at the observation motion step.

The magnitude of electric current to be supplied to the motor may be changed depending upon the rotation velocity set with respect to the drum motion. However, the amount of electric current supplied to the motor at the beginning of the drum motion in which the drum starts to be rotated in a state in which the drum is stopped greatly depends on the amount of laundry.

Meanwhile, since the maximum value of the observation motion execution current is the maximum value of electric current supplied to the motor so as to rotate the drum to the observation reference angle from a state in which the drum is stopped, the maximum value of the observation motion execution current is set in consideration of an initial value of electric current necessary when the drum, in which laundry is placed, is rotated in the rotation direction set with respect to the drum motion from a state in which the drum is stopped. When electric current equal to the maximum value of the observation motion execution current is supplied to the motor at the acceleration motion step, therefore, it is possible to minimize the occurrence of current peak at which the amount of electric current supplied to the motor is abruptly increased in the section (O-B section) in which load of the motor is maximized. In addition, since, at the acceleration motion step, the drum is rotated using the potential energy obtained by the laundry through the inertia motion step, it is possible to reduce load of the motor in the maximum load section (O-B section), and therefore, it is possible to further reducing the occurrence of current peak.

Upon completion of the acceleration motion step, the conversion motion step as shown in FIG. 5E is performed. At the conversion motion step, the magnitude of electric current supplied to the motor is converted from the value of electric current (the maximum value of the observation motion execution current) supplied to the motor at the acceleration motion step to the value of electric current necessary to maintain the rotation velocity (rpm) set with respect to the drum motion.

The point of time when the conversion motion step is commenced may be detected by monitoring the rotation angle of the drum using a sensing device, such as a Hall effect sensor. Each drum motion is performed from the point of time when the amount of electric current supplied to the motor through the conversion motion.

In a case in which the washing machine having the preceding motion step as described above, the secondary laundry amount determination step is preferably performed during the observation motion step. Hereinafter, a control method of the washing machine to perform the secondary laundry amount determination step at the observation motion step will be described with reference to FIG. 6.

The control method of the washing machine according to this embodiment includes a primary laundry amount determination step (S100'), a control data setting step (S200'), a control data display step (S300'), and a water supply step (S400'). These steps are identical to those of the control method as previously described, and therefore, a detailed description thereof will not be given.

Meanwhile, a secondary laundry amount determination step (S500') according to this embodiment may include an observation motion step (S510') and a before-water-supply motor load estimation step (S530').

At the observation motion step (S510'), the drum is rotated to the observation reference angle in the direction opposite to the rotation direction set with respect to the drum motion at a washing step (S700') to measure electric current (after-water-supply motor load) supplied to the motor (S513') at the observation motion step.

Therefore, the observation motion step (S510') corresponds to the drum rotation step and the after-water-supply motor load measurement step disclosed in the embodiments of FIGS. 2 to 4. The observation reference angle corresponds to the reference angle disposed in the embodiments of FIGS. 2 to 4.

When the after-water-supply motor load is measured through the observation motion step (S510'), before-water-supply motor load is estimated from the after-water-supply motor load, and then a laundry amount verification step (S600') is performed. When the laundry amount (motor load or laundry amount level) determined at the primary laundry amount determination step is equal to the laundry amount (motor load or laundry amount level) determined at the secondary laundry amount determination step, a washing step (S700') is performed based on the control data set at the control data setting step (S200'). On the other hand, when the laundry amount (motor load or laundry amount level) determined at the primary laundry amount determination step is different from the laundry amount (motor load or laundry amount level) determined at the secondary laundry amount determination step, a control data resetting step (S635') and a resetting display step (S637') are performed, and then the washing step (S700') is performed.

Meanwhile, in this embodiment, an inertia motion step (S570'), an acceleration motion step (S590'), and a conversion motion step (not shown) are performed after the completion of the observation motion step (S510') and before the commencement of the washing step (S700'), thereby preventing the occurrence of current peak at the washing step (S700').

In the control method according to this embodiment, therefore, it is possible to improve safety of the washing machine and, in addition, to correct control data through verification of the amount of laundry.

Also, the control method according to this embodiment may further include a step (S65') of determining kind of laundry based on absorptance of the laundry as shown in FIG. 3. This step was previously described with reference to FIG. 3, and therefore, a detailed description thereof will not be given.

MODE FOR THE INVENTION

Various embodiments have been described in the best mode for carrying out the invention.

INDUSTRIAL APPLICABILITY

The present invention provides a control method of a washing machine that is capable of accurately determining the amount of laundry placed in a drum.

Also, the present invention provides a control method of a washing machine that is capable of verifying whether the measured amount of laundry is accurate and correcting control data necessary to operate the washing machine based on the verified amount of laundry.

Also, the present invention provides a control method of a washing machine that is capable of determining kind of laundry classified based on absorptance and correcting control data set based on the amount of laundry to control data based on the kind of laundry.

Therefore, the present invention has industrial applicability.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A control method of a washing machine comprising a cabinet, a tub provided in the cabinet for containing wash water, a drum rotatably mounted in the tub for receiving laundry through a front of the washing machine and for containing laundry, and a motor for rotating the drum about a shaft that is mounted to a rear of the tub, comprising:

a receiving step of receiving laundry to the drum;

a primary amount determination step of determining an amount of the laundry received at the receiving step by measuring a before-water-supply motor load before supplying water to the tub;

before supplying water to the tub, a data setting step of setting control data, setting the control data comprising setting a drum motion defined as a movement pattern of laundry in the drum based on the amount of the laundry determined at the primary amount determination step;

a water supply step of supplying water to the tub based on the data setting step;

a secondary amount determination step comprising determining the amount of the laundry received at the receiving step by measuring an after-water-supply motor load after the water supply step, and estimating the before-water-supply motor load based on the measured after-water-supply motor load;

a comparison step of comparing the measured before-water-supply motor load with the estimated before-water-supply motor load;

after the water supply step, a data resetting step of resetting, conditioned on the measured before-water-supply motor load being different from the estimated before-water-supply motor load, the control data based on the amount of the laundry determined at the secondary amount determination step;

a resetting display step of displaying, on a display located outside of the washing machine, the control data that have been reset conditioned on the measured before-water-supply motor load being different from the estimated before-water-supply motor load; and a washing step of rotating, after the water supply step and without an additional water supply step, the drum in a predetermined rotation direction based on the control data set in the data setting step or the data resetting step.

2. The control method according to claim 1, wherein the secondary amount determining step comprises:

an observation motion step of rotating the drum to a reference angle in a direction opposite to the predetermined rotation direction set at the washing step to measure the amount of laundry placed in the drum, and an acceleration motion step of rotating the drum in a direction identical to the predetermined rotation direction using potential energy obtained from the laundry in the observation motion step, and, wherein the primary amount determination step comprises rotating the drum to a predetermined reference angle to measure the before-water-supply motor load, the secondary amount determination step further comprises a measuring step of measuring the after-water-supply motor load during the observation motion step, and the data resetting step comprises resetting the control data based on the measured before-water-supply motor load estimated at the secondary amount determination step based on the measured before-water-supply motor load measured at the primary amount determination step being different from the estimated before-water-supply motor load estimated at the secondary amount determination step.

3. The control method according to claim 2, wherein estimating the before-water-supply motor load based on the measured after-water-supply motor load comprises comparing the after-water-supply motor load measured at the secondary amount determination step with motor load data that is a variation value of arbitrary before-water-supply motor load after supplying wash water to the tub.

4. The control method according to claim 2, wherein the primary amount determination step selects a primary amount level to which the measured before-water-supply motor load belongs among a before-water-supply laundry amount level having an upper limit and a lower limit of the motor load, the secondary amount determination step selects a secondary amount level to which the measured after-water-supply motor load belongs among an after-water-supply laundry amount level having an upper limit variation value and a lower limit variation value of the motor load, wherein the upper limit variation value and the lower limit variation value are a variation value of the upper limit and the lower limit of the motor load of the before-water-supply laundry amount level when a predetermined amount of wash water is supplied to the tub, and the data resetting step comprises resetting the control data based on the secondary amount level when the primary amount level is different from the secondary amount level.

5. The control method according to claim 2, wherein the primary amount determination step comprises measuring electric current supplied to the motor so as to rotate the drum to the reference angle to measure the before-water-supply motor load, and the secondary amount determination step comprises measuring electric current supplied to the motor during the observation motion step to measure the after-water-supply motor load.

6. The control method according to claim 1, further comprising a resetting display step of displaying, on the display, the control data set at the data setting step.

7. The control method according to claim 2, further comprising:

a laundry amount verification step of determining whether the measured before-water-supply motor load measured at the primary amount determination step is equal to the estimated before-water-supply motor load estimated at the secondary amount determination step, the laundry amount verification step being performed before the data resetting step; and a laundry amount verification notification step of notifying a user that the laundry amount verification step is in progress.

8. The control method according to claim 2, further comprising:

a step of determining kind of the laundry based on absorptance of the laundry using load variation, which is a difference between the measured before-water-supply motor load and the after-water-supply motor load; and a secondary resetting step of changing the control data reset at the data resetting step to control data set based on the kind of the laundry.

9. The control method according to claim 2, further comprising:

a step of determining load variation, which is a difference between the measured before-water-supply motor load and the after-water-supply motor load; and a secondary resetting step of changing the control data reset at the data resetting step to a predetermined control data when the load variation is equal to or greater than predetermined reference load variation.

10. The control method according to claim 9, further comprising a secondary resetting display step of displaying the control data reset at the secondary resetting step at an outside of the washing machine.

11. The control method according to claim 2, wherein setting the control data further comprises setting an actual operation ratio defined as a ratio of motor ON time to the sum of motor ON time and motor OFF time.

12. The control method according to claim 2, wherein setting the control data further comprises setting an operation time of the washing machine.

13. The control method according to claim 2, wherein the after-water-supply motor load measured at the secondary amount determination step is obtained by measuring the electric current supplied to the motor so as to rotate the drum to the reference angle at the observation motion step.

14. The control method according to claim 2, wherein the acceleration motion step comprises supplying electric current of the same magnitude as the electric current measured at the observation motion step to the motor.

15. The control method according to claim 14, further comprising an inertia motion step of stopping supply of the electric current to the motor, when the drum is rotated to the reference angle, such that the drum is rotated by inertia, the inertia motion step being performed between the observation motion step and the acceleration motion step.

16. The control method according to claim 1, wherein the secondary amount determining step comprises:

an observation motion step of rotating the drum to a reference angle in a direction opposite to the predetermined rotation direction set at the washing step to measure the amount of laundry placed in the drum, and an acceleration motion step of rotating the drum in a direction identical to the predetermined rotation direction using potential energy obtained from the laundry in the observation motion step.

17. The control method according to claim 16, wherein the reference angle of the observation motion step is a predetermined reference angle.

18. The control method according to claim 17, wherein the secondary amount determination step further comprises a measuring step of measuring after-water-supply motor load during the observation motion step, and wherein the after-water-supply motor load measured is obtained by measuring the electric current supplied to the motor so as to rotate the drum to the predetermined reference angle.

19. A control method of a washing machine comprising a cabinet, a tub provided in the cabinet for containing wash water, a drum rotatably mounted in the tub for receiving laundry through a front of the washing machine and for containing laundry, and a motor for rotating the drum about a shaft that is mounted to a rear of the tub, comprising:

a receiving step of receiving laundry to the drum;

a primary amount determination step of determining an amount of the laundry received at the receiving step by measuring a before-water-supply motor load before the water supply step;

a data setting step of setting control data, setting the control data comprising a drum motion defined as a movement pattern of laundry in the drum based on the amount of the laundry determined at the primary amount determination step;

a water supply step of supplying water to the tub based on the data setting step;

a secondary amount determination step comprising determining the amount of the laundry received at the receiving step by measuring after-water-supply motor load after the water supply step, and estimating the before-water-supply motor load based on the measured after-water-supply motor load;

a comparison step of comparing the measured before-water-supply motor load with the estimated before-water-supply motor load;

a data resetting step of resetting, after the water supply step and conditioned on the measured before-water-supply motor load being different from the estimated before-water-supply motor load, the control data based on the amount of the laundry determined at the secondary amount determination step;

a resetting display step of displaying, on a display located outside of the washing machine, the control data that have been reset conditioned on the measured before-water-supply motor load being different from the estimated before-water-supply motor load; and a washing step of rotating, after the water supply step and without an additional water supply step, the drum in a predetermined rotation direction based on the control data set in the data setting step or the data resetting step, wherein the secondary amount determining step comprises:

an observation motion step of rotating the drum to a reference angle in a direction opposite to the predetermined rotation direction set at the washing step to measure the amount of laundry placed in the drum, and an acceleration motion step of rotating the drum in a direction identical to the predetermined rotation direction using potential energy obtained from the laundry in the observation motion step, wherein the reference angle of the observation motion step is a predetermined reference angle, wherein the secondary amount determination step further comprises a measuring step of measuring after-water-supply motor load during the observation motion step, and wherein the after-water-supply motor load measured is obtained by measuring the electric current supplied to the motor so as to rotate the drum to the predetermined reference angle.

20. The method according to claim 1, wherein the data setting step comprises setting the drum motion to cause the laundry in the drum, during the washing step, to fall from a predetermined position at an inner circumferential surface of the drum to a lowest position of the drum based on rotation of the drum.

* * * * *